US010114337B2

(12) United States Patent
Honke et al.

(10) Patent No.: US 10,114,337 B2
(45) Date of Patent: Oct. 30, 2018

(54) FIXING DEVICE AND IMAGE-FORMING APPARATUS

(71) Applicant: CANON KABUSHIKI KAISHA, Tokyo (JP)

(72) Inventors: Takashi Honke, Mishima (JP); Satoru Taniguchi, Mishima (JP); Mahito Yoshioka, Numazu (JP); Hirohiko Aiba, Suntou-gun (JP); Taisuke Minagawa, Suntou-gun (JP); Masaki Hirose, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/353,202

(22) Filed: Nov. 16, 2016

(65) Prior Publication Data

US 2017/0139373 A1 May 18, 2017

(30) Foreign Application Priority Data

Nov. 17, 2015 (JP) ..... 2015-224574

(51) Int. Cl.
*G03G 15/20* (2006.01)
*G03G 21/20* (2006.01)

(52) U.S. Cl.
CPC ..... *G03G 21/203* (2013.01); *G03G 15/2039* (2013.01)

(58) Field of Classification Search
CPC ..... G03G 21/203; G03G 15/2039
USPC ..... 399/44
See application file for complete search history.

(56) References Cited

U.S. PATENT DOCUMENTS

2004/0042827 A1* 3/2004 Izawa ..... G03G 15/2064 399/328
2008/0124140 A1* 5/2008 Thomas ..... G03G 15/2028 399/323
2012/0063798 A1* 3/2012 Lee ..... G03G 15/2025 399/67

(Continued)

FOREIGN PATENT DOCUMENTS

JP 2000-131974 A 5/2000
JP 2000305395 A * 11/2000
JP 2001194933 A * 7/2001 ..... G03G 15/2064

(Continued)

*Primary Examiner* — Susan Lee
(74) *Attorney, Agent, or Firm* — Canon U.S.A., Inc. IP Division

(57) ABSTRACT

An image-forming apparatus includes an image-forming unit, a fixing device including a heating rotator and a pressure member forming a nip portion together with the heating rotator, and a bias-applying unit applying bias to the heating rotator. Image forming modes each having a time interval between a preceding recording material and a succeeding recording material which is different from each other can be performed. A control unit executes a first control while the recording materials are being conveyed at the nip portion, and a second control while the recording materials are not being conveyed at the nip portion due to the time interval. A switching time in the image forming mode in which the time interval is a first time interval is determined to be longer than in the image forming mode in which the time interval is a second time interval shorter than the first time interval.

8 Claims, 7 Drawing Sheets

(56) References Cited

U.S. PATENT DOCUMENTS

2015/0277310 A1* 10/2015 Ohnishi ..... G03G 15/2017
399/67

FOREIGN PATENT DOCUMENTS

| | | | |
|---|---|---|---|
| JP | 2002-123109 | A | 4/2002 |
| JP | 2009-229550 | A | 10/2009 |
| JP | 2010-128474 | A | 6/2010 |
| JP | 5202056 | B2 * | 6/2013 |

* cited by examiner

FIXING DEVICE AND IMAGE-FORMING APPARATUS

BACKGROUND OF THE INVENTION

Field of the Invention

One disclosed aspect of the embodiments relates to a fixing device that fixes a toner image formed on a recording material by heating, and an image-forming apparatus using the fixing device such as an electrophotographic printer or a copying machine.

Description of the Related Art

A fixing device of a film-heated type, subsequently mentioned, has been known as a fixing device mounted on a conventional image-forming apparatus (Japanese Patent Laid-Open No. 2000-131974).

The fixing device includes a cylindrical fixing film that is heated by a heater and a pressure roller that forms a nip portion together with the heater with the fixing film interposed therebetween. In the fixing device, a recording material on which a toner image is formed is heated at the nip portion while being conveyed, and the toner image is fixed on the recording material.

In the fixing device, a failure in an image called "end tailing" may occur. The tailing means a phenomenon in which water vapor emitted from the inside of the recording material causes a toner image to be scattered in the direction opposite the direction in which the recording material is conveyed in the case where the toner image is fixed by heating on the recording material that is hygroscopic.

In Japanese Patent Laid-Open No. 2000-131974, a method of applying bias having the same polarity as a toner to the fixing film to form an electric field in the direction in which the toner is attracted to the recording material is disclosed as a countermeasure against the tailing. The electric field causes the toner to be pressed against the recording material. Consequently, the scatter of the toner image due to water vapor is suppressed.

In addition to the tailing failure, a failure in an image called an "offset" that occurs in fixing devices has been known. The offset means a phenomenon that occurs such that a surface of the pressure roller is gradually charged up while the recording material is conveyed at the nip portion, and consequently, an unfixed toner on the recording material is ripped off.

In Japanese Patent Laid-Open No. 2010-128474, a method of applying bias having a polarity opposite to the polarity of a toner to the fixing film or the pressure roller during a period in which the recording material does not pass through the nip portion to prevent the pressure roller from being charged up is disclosed as a countermeasure against the offset.

In recent years, however, it is difficult for the problems of the "offset" and "end tailing" to be solved at the same time because the print speed of image-forming apparatuses is increased, and the period in which the recording material does not pass through the nip portion is short. The reason will be described.

The "offset" is caused by the force of an electric field that causes the toner to be attracted to the fixing film and that is generated when a recording material P is fed and the pressure roller is charged up so as to have the same polarity as the tonner. The image-forming apparatus, which is difficult to ensure a sufficient time interval between sheets, cannot ensure a sufficient time for applying the bias having a polarity opposite to the polarity of the toner in the time interval between sheets.

Consequently, a sufficient electrical charge cannot be applied to the pressure roller. This reduces the effect of preventing the charging-up, and the "offset" may occur.

In order to apply a sufficient electrical charge having a polarity opposite to the polarity of the toner to the pressure roller in a short time interval between sheets, the time for applying the bias having a polarity opposite to the polarity of the toner to the fixing film in the time interval between sheets can be increased. This, however, shortens a switching time between performing switching such that the bias having the same polarity as the toner is applied when a succeeding recording material P passes through a nip portion N and the succeeding recording material P passing through a fixing nip. Consequently, the "end tailing" may occur.

SUMMARY OF THE INVENTION

According to a first aspect of the embodiments, an image-forming apparatus for forming a toner image on a recording material includes an image-forming unit, a fixing device, a bias-applying unit, and a control unit. The image-forming unit forms an unfixed toner image on the recording material. The fixing device fixes the unfixed toner image formed on the recording material by the image-forming unit on the recording material and that includes a heating rotator and a pressure member that forms, together with the heating rotator, a nip portion at which the recording material is heated and conveyed. The bias-applying unit applies bias to the heating rotator. The control unit controls the bias-applying unit. A plurality of image forming modes can be performed in a case where image formation is successively performed on a preceding recording material and a succeeding recording material. Each of the plurality of image forming modes has a time interval between the preceding recording material and the succeeding recording material which is different from each other. The control unit executes a first control of the bias-applying unit such that bias having the same polarity as a toner of the unfixed toner image is applied while the recording materials are being conveyed at the nip portion, and a second control of the bias-applying unit such that bias having a polarity opposite to a polarity of the toner is applied while the recording materials are not being conveyed at the nip portion due to the time interval. A switching time between start of switching from the first control to the second control and completion of the switching in the image forming mode in which the time interval is a first time interval is determined to be longer than in the image forming mode in which the time interval is a second time interval shorter than the first time interval.

Further features of the disclosure will become apparent from the following description of exemplary embodiments with reference to the attached drawings.

DESCRIPTION OF THE EMBODIMENTS

One mode for carrying out the disclosed techniques will hereinafter be described in detail by way of example based on embodiments with reference to the drawings.

First Embodiment

Figure 1:
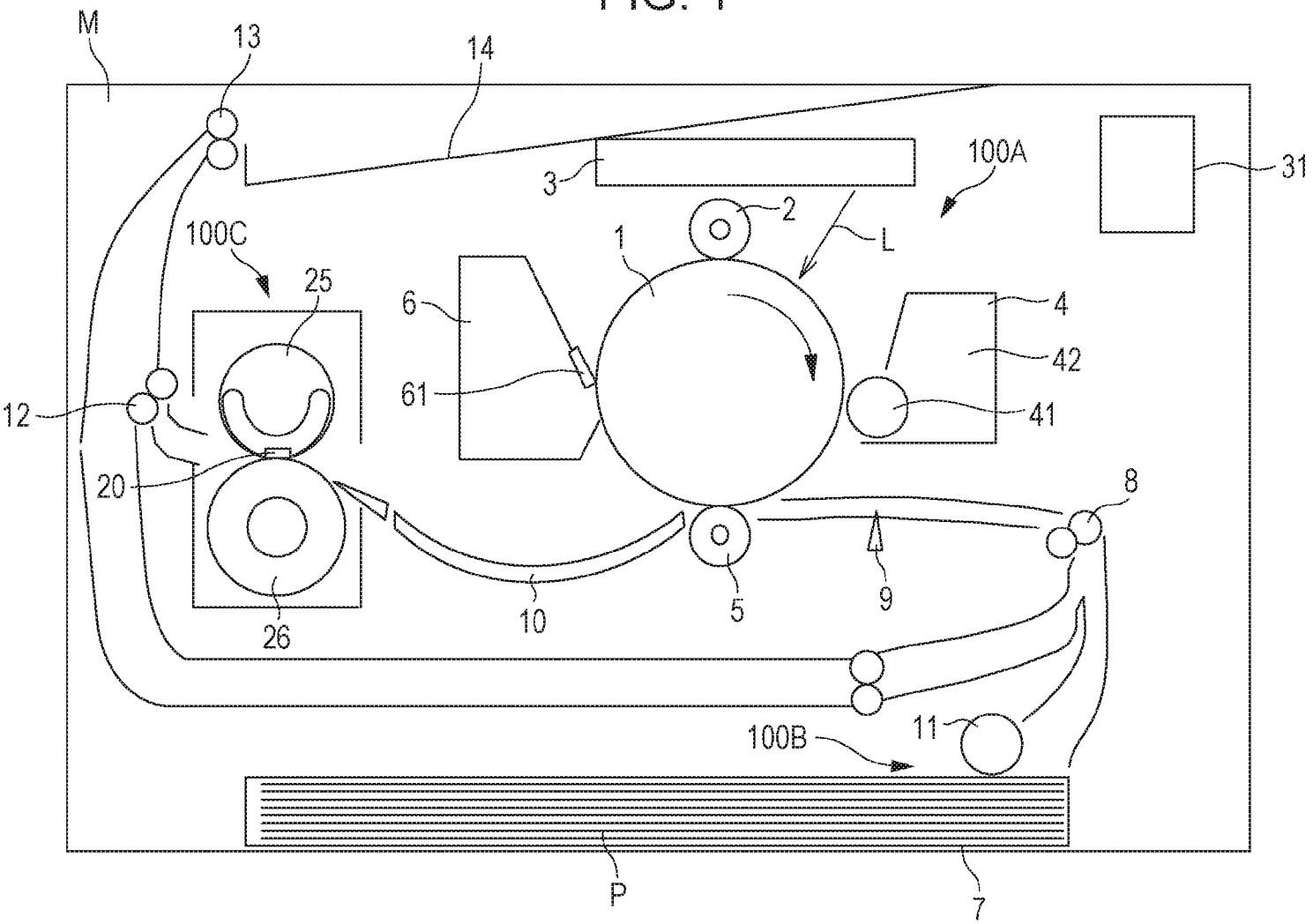
FIG. 1 is a sectional view of an image-forming apparatus according to a first embodiment.

FIG. 1 is a sectional view of an image-forming apparatus according to a first embodiment.

Schematic Structure of Image-Forming Apparatus

The image-forming apparatus includes an image-forming unit 100A that forms a toner image on a recording material, a recording-material feeding unit 100B that feeds the recording material to the image-forming unit 100A, and a fixing device 100C that fixes the toner image formed on the recording material on the recording material by heating. The term "fix" here may mean "fasten something in a position," "apply something to a device or surface," "transfer something from one location, surface or device to another location, surface, or device," or similar operations.

The image-forming unit 100A includes a drum-type electrophotographic photosensitive member 1 (referred to as a photosensitive drum below) as an image-bearing member. The photosensitive drum 1 is rotatably supported by a main body M of the image-forming apparatus (referred to as a main body of the apparatus below) that forms a housing of the image-forming apparatus. A charge roller 2, a laser scanner 3, a developing device 4, a transfer roller 5, and a cleaning device 6 are disposed around the outer circumferential surface of the photosensitive drum 1 in order along the rotation direction of the photosensitive drum 1.

The recording-material feeding unit 100B includes a feed roller 11. The feed roller 11 is rotated by a conveying drive motor, not illustrated, in an arrow direction with a predetermined timing. A conveyance roller 8, a top sensor 9, a conveyance guide 10, a fixing unit 100C (represented as the fixing device), a conveyance roller 12, a discharge roller 13, and a discharge tray 14 are disposed in order along a conveyance path for the recording material P that is stacked and contained in a cassette 7.

The image-forming apparatus according to the first embodiment includes the image-forming unit 100A, the recording-material feeding unit 100B, and a control unit 31 that controls, for example, the fixing device 100C. The control unit 31 includes a CPU and a memory such as a ROM or a RAM. Various programs needed to form an image are stored in the memory.

The control unit 31 receives print signals from an external device such as a host computer and executes a predetermined sequence of image formation control in response to the print signals. This causes a drum motor to rotate, and the photosensitive drum 1 rotates in an arrow direction at a predetermined circumferential speed (process speed). A surface of the rotating photosensitive drum 1 is uniformly charged by the charge roller 2 so as to have a predetermined electric potential having the same polarity (here, a negative polarity) as the toner. The laser scanner 3 scans a laser beam L over the charged surface of the photosensitive drum 1 on the basis of image information, and the surface of the photosensitive drum 1 is exposed to light. The exposure to light removes the electrical charge of the exposed portion, and an electrostatic latent image is formed on the surface of the photosensitive drum 1.

The developing device 4 includes, for example, a developing roller 41 and a toner container 42 in which the toner is contained. The toner is rubbed by, for example, a urethane blade member, not illustrated, and charged so as to have a predetermined polarity. In the first embodiment, the toner is charged so as to have the negative polarity. In the developing device 4, negative bias is applied to the developing roller 41 by using a developing bias source (not illustrated), the toner is attached to the electrostatic latent image on the surface of the photosensitive drum 1 by using an electric potential difference, and the electrostatic latent image is developed as an unfixed toner image T. The toner image T formed on the surface of the photosensitive drum 1 is transferred to the recording material P by using an electric potential difference due to transfer bias in a manner in which positive bias, which has a polarity opposite to the polarity of the toner, is applied to the transfer roller 5.

The conveying drive motor disposed in the recording-material feeding unit 100B is rotated, and the feed roller 11 feeds the recording material P from the cassette 7 to the conveyance roller 8. The recording material P is conveyed by the conveyance roller 8, passes through the top sensor 9, and is conveyed to a transfer nip portion between the surface of the photosensitive drum 1 and the outer circumferential surface of the transfer roller 5. At this time, the position of an end of the recording material P is detected by the top sensor 9, which serves as a detector.

The recording material P to which the toner image T formed on the surface of the photosensitive drum 1 is transferred is conveyed to the fixing device 100C along the conveyance guide 10, and the toner image T on the recording material P is heated and pressed by the fixing device 100C and fixed on the recording material P by heating.

The recording material P on which the toner image T is fixed by heating is conveyed to the conveyance roller 12 and the discharge roller 13 in this order and discharged to the discharge tray 14, which is the upper surface of the main body M of the apparatus.

Residual toner that remains on the surface of the photosensitive drum 1 after the toner image is transferred to the recording material P is removed by a cleaning blade 61 of the cleaning device 6 and accumulated in the cleaning device 6. The above actions are repeated for successive printing. In the case of A4 size, the image-forming apparatus according to the first embodiment enables printing at a print speed of 60 pieces per minute.

Structure of Fixing Device

Figure 2:
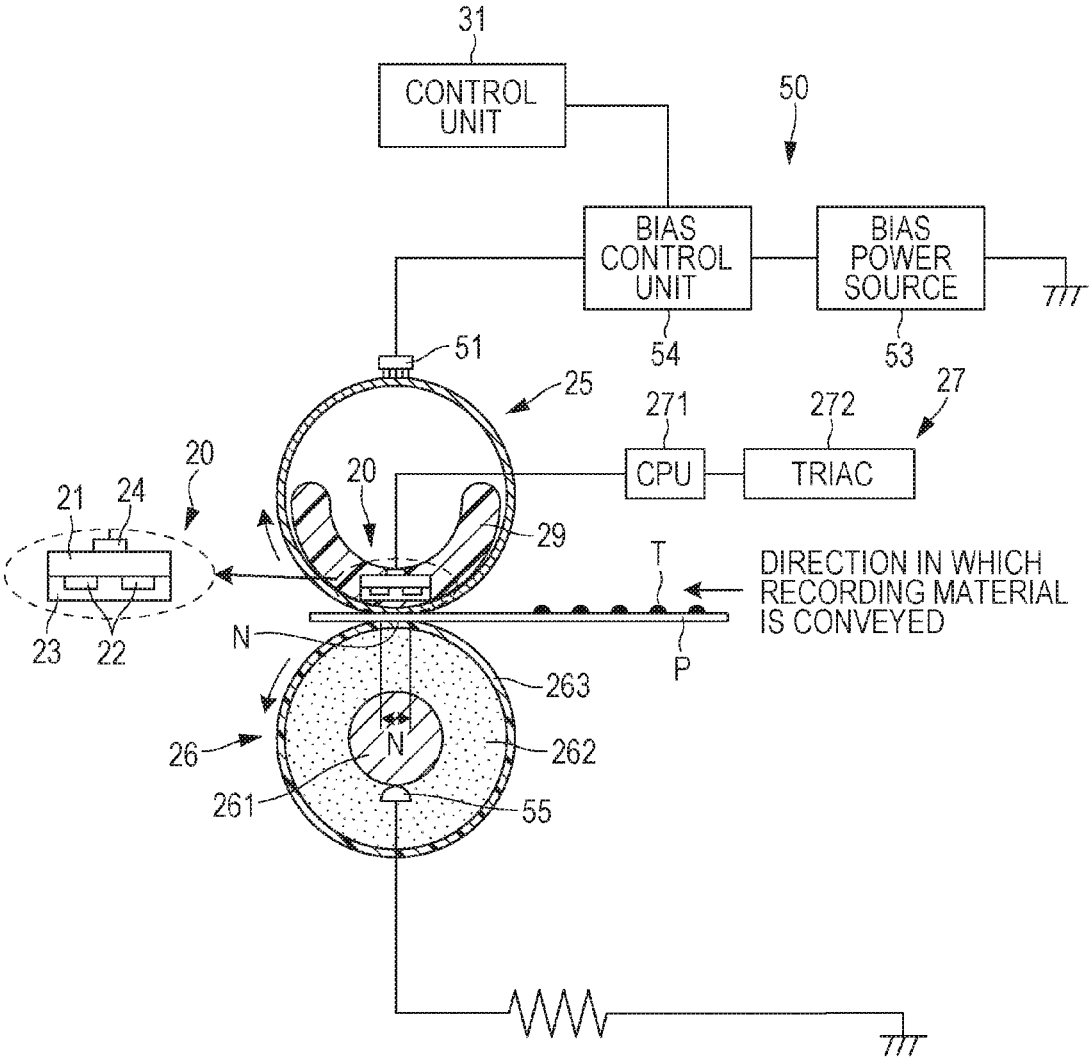
FIG. 2 is a sectional view of a fixing device according to the first embodiment.

FIG. 2 is a cross-sectional side view of the fixing device of the image-forming apparatus according to the first embodiment.

The fixing device 100C according to the first embodiment includes a cylindrical fixing film 25 (heating rotator) that is heated by a ceramic heater 20 serving as a heating member and a pressure roller 26 serving as a pressure member that comes into contact with the fixing film 25 and forms the nip portion. The recording material on which the unfixed toner image is formed is heated at the nip portion while being conveyed, and the toner image is fixed on the recording material. This is a basic structure of the fixing device 100C.

Structural features of the first embodiment include a bias-applying unit 50 that applies bias to the fixing film 25.

That is, bias having the same polarity as the toner is applied to the fixing film 25, and bias having a polarity opposite to the polarity of the toner is applied to the fixing film 25.

Heater

The ceramic heater 20 includes a heat-resistant heater substrate 21 made of, for example, aluminum nitride or alumina. Resistance patterns 22 serving as energization heat-generating resistance layers that generate heat when being energized are formed on a surface of the heater substrate 21, for example, in the longitudinal direction of the heater substrate 21 by printing. Surfaces of the resistance patterns 22 are coated with a glass layer 23 serving as a protective layer. A thermistor 24 serving as a temperature detecting member that detects the temperature of the ceramic heater 20 is disposed on the back surface (surface opposite the nip portion N) of the heater substrate 21. A film-guiding member 29 acts as a support member that supports the ceramic heater 20 and also acts as a guiding member that guides the fixing film 25 to be rotated. The material of the film-guiding member 29 is a heat-resistant resin such as a liquid-crystal polymer, a phenol resin, PPS, or PEEK.

Pressure Roller

The pressure roller 26 includes an elastic layer 262 disposed on the outer circumference of a core shaft 261 and a surface layer 263 disposed on the outer circumference of the elastic layer 262. The outer diameter of the pressure roller 26 is about 30 mm. A solid or hollow metal material such as aluminum or iron is used for the core shaft 261. In the first embodiment, a solid aluminum material is used as the metal material. The elastic layer 262 is made of a heat-insulating silicone rubber containing an electrically conductive material such as carbon and is thus conductive. In the first embodiment, the elastic layer 262 is made of silicone rubber that contains a proper amount of carbon and whose volume resistivity is adjusted to be about $1\times10^5$ (Ω·cm) and has a thickness of 3 mm.

The surface layer 263 is a tube that is made of a fluorine resin such as PFA, PTFE, or FEP and has a release property and a thickness of 10 to 80 μm. PFA is an abbreviation of tetrafluoroethylene-perfluoroalkyl vinyl ether copolymer, PTFE is an abbreviation of polytetrafluoroethylene (tetrafluoride), and FEP is an abbreviation of tetrafluoroethylene-hexafluoropropene copolymer (tetrafluoride, hexafluoride).

In the first embodiment, the material of the surface layer 263 of the pressure roller 26 is an insulating fluorine resin (pure PFA tube having a thickness of 30 μm). Accordingly, the volume resistivity of the pressure roller 26 according to the first embodiment is a high resistivity of $1\times10^{14}$ (Ω·cm) or more. The reason why the pure fluorine resin is used is that adding, for example, carbon to the surface layer 263 to reduce the resistivity may cause a reduction in surface smoothness and contamination due to a toner or paper powder.

Fixing Film

Figure 3:
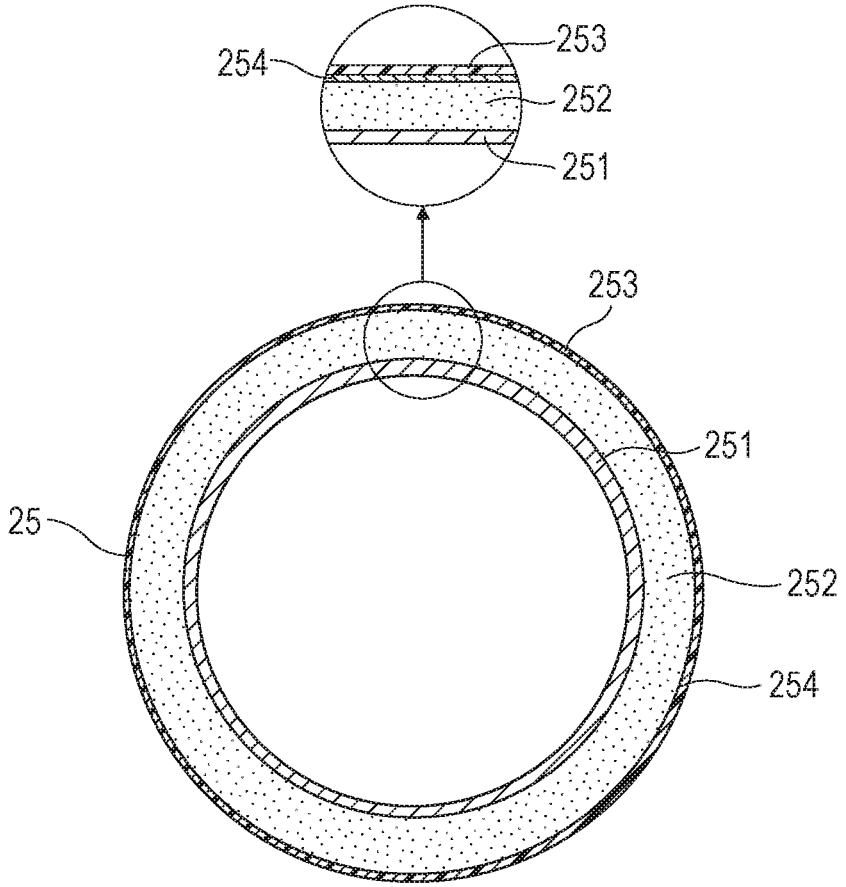
FIG. 3 is a sectional view of a fixing film according to the first embodiment.

The fixing film 25 (endless belt-like heat-resistant film) is cylindrical and has a diameter of 30 mm. The fixing film 25 is flexible and disposed outside the film-guiding member 29 in a semi-circular shape so as to be loose with respect to the film-guiding member 29. As illustrated in a circle in FIG. 3, the layered structure of the fixing film 25 has a multilayer of a base layer 251, an elastic layer 252, and a surface layer 253 that are disposed in this order from the inside.

A thin metal material such as SUS or Ni is used as the material of the base layer 251 to increase the thermal conductivity and durability. A heat-resistant resin material having a low heat capacity such as polyimide, polyamide imide, PEEK, or PES may be used as another material. The base layer 251 is required to reduce the thermal capacity to achieve a quick-start property while having a sufficient mechanical strength, and accordingly, the thickness thereof is preferably no less than 15 μm and no more than 50 μm. The base layer 251 according to the first embodiment is a stainless steel (SUS) circular tube having a thickness of 35 μm. The elastic layer 252 is formed of a silicone rubber material. The elastic layer 252 enables the toner image T to be wrapped and to be uniformly heated. Accordingly, a high quality image having a high glossiness and uniformity can be obtained. A thermally conductive filler is added to the elastic layer 252 because silicone rubber, as a single item, has a low thermal conductivity. The thermal conductivity of the elastic layer 252 is preferably 1.2 W/mk or more.

Examples of the thermally conductive filler include alumina, metallic silicon, silicon carbide, and zinc oxide. In the first embodiment, the elastic layer 252 contains 400 parts of metallic silicon by weight, which is a thermally conductive filler, with respect to 100 parts of dimethylpolysiloxane by weight, which is a rubber material. The thermal conductivity thereof is 1.2 W/mk. The thickness of the elastic layer 252 is 210 μm.

The surface layer 253 serves as a release layer and is required to have a high wear resistance and a high release property against the toner. The material thereof is the above fluorine resin such as PFA, PTFE, or FEP. An ion conductive agent such as an organophosphorus compound or a lithium salt, or an electronically conductive material such as antimony pentoxide, titanium oxide, carbon black, or carbon nanofiber is added to the fluorine resin to adjust the resistivity. The thickness is preferably about 10 μm to 50 μm. A tube with a coating may be used, or the surface may be coated with paint.

The surface layer 253 according to the first embodiment uses PFA as the fluorine resin. Seven parts of an organophosphorus compound by weight that is expressed by $(C_2H_5)_4P\cdot BR$, Hishicolin PX-2B (made by Nippon Chemical Industrial Co., Ltd), are added to PFA. The surface layer 253 has a thickness of 15 μm and is a coating layer.

Bias-Applying Unit

The bias-applying unit 50, which is a structural feature of the first embodiment, will now be described.

Bias is applied to the fixing film 25 in a manner in which the bias is applied from a bias power source 53 to the conductive base layer 251 that is partially exposed from the surface of the fixing film 25 via a power supplier 51 such as a conductive brush. The pressure roller 26 is grounded from the core shaft 261 with a power supply member 55 such as a carbon chip interposed therebetween.

In the first embodiment, the bias to be applied to the fixing film 25 can be switched between bias (negative bias) having the same polarity as the toner and bias (positive bias) having a polarity opposite to the polarity of the toner.

The magnitude of the bias is +800 V for the positive bias and −500 V for the negative bias. The bias is applied with the bias power source 53 composed of, for example, a transformer and a resistance. A bias control unit 54 switches the bias by using, for example, a relay. The control of the bias control unit 54 when the negative bias is applied to the fixing film 25 is referred to as first control. The control of the bias control unit 54 when the positive bias is applied to the fixing film 25 is referred to as second control.

During a period (referred to as a conveyance period below) in which the recording material P is conveyed at the nip portion N, the bias control unit 54 executes the first control to apply the negative bias to the fixing film 25.

During a period in which no recording material P is conveyed at the nip portion N, that is, during a period (referred to as a time interval between sheets below) in which the nip portion N is located within the interval between a preceding recording material and a succeeding recording material, the bias control unit 54 executes the second control to apply the positive bias to the fixing film 25. The purpose thereof will be described. The image-forming apparatus according to the first embodiment can perform a plurality of image forming modes having different time intervals between sheets.

The bias having the same polarity as the toner is applied during the conveyance period to suppress tailing. The tailing means a problem in that water vapor emitted from the recording material P causes the toner of the toner image T to be scattered in the direction opposite the direction in which the recording material P is conveyed when the recording material P passes through the fixing nip, resulting in a failure in an image. When the negative bias is applied to the fixing film, the force of an electric field acts on the toner of the unfixed toner image T so as to press the toner against the recording material P, and accordingly, the occurrence of the tailing can be prevented.

The bias having a polarity opposite to the polarity of the toner is applied during the time interval between sheets to suppress an electrostatic offset. The electrostatic offset means a phenomenon that occurs such that the toner of the unfixed toner image T formed on the recording material P is ripped off from the recording material P by an electrostatic force at the nip portion N and attached to the fixing film 25, and the attached toner appears as an image in succeeding printing.

The electrostatic offset is a phenomenon that is likely to occur after a large quantity of the recording materials P are fed. The reason is as follows. The surface layer of the pressure roller 26 has a high resistance of $1\times10^{14}$ (Ω·cm) or more, as described above. PFA that is a material of which the surface layer 263 of the pressure roller 26 is composed is likely to be negatively charged due to friction against the recording materials P. Accordingly, when the recording materials P are fed, a negative electrical charge is accumulated in the surface layer 263 of the pressure roller 26 due to the friction, resulting in charging-up. As the number of the recording materials P that are fed increases, a negative surface potential of the pressure roller 26 becomes smaller than the surface potential of the fixing film 25 (reversal of the electric potential). Consequently, the toner of the unfixed toner image T is ripped off from the recording material P due to an electrostatic force and attached to the fixing film. The electrostatic offset thus occurs.

An effective countermeasure against the electrostatic offset is to apply the positive bias to the fixing film 25 and apply a positive electrical charge to the surface layer 263 of the pressure roller 26 via the surface layer 253 of the fixing film 25 in the time interval between sheets. The reason is that the negative electrical charge applied during the conveyance period is canceled by using the positive electrical charge applied from the surface layer of the fixing film in the time interval between sheets, and the surface layer 263 of the pressure roller 26 can thereby be prevented from being charged up so as to have the same polarity as the toner. Consequently, a sufficient electric field to press the toner of the unfixed toner image T against the recording material P can be formed between the surface of the fixing film and the surface of the pressure roller, and the offset does not occur. The positive bias may be applied to the core shaft 261 of the pressure roller 26 to apply the positive electrical charge to the surface of the pressure roller. However, in the case where the electrical resistivity of the surface layer 263 of the pressure roller 26 is high as in the first embodiment, applying the electrical charge via the surface of the fixing film 25 having a lower electrical resistivity is efficient.

Timing of Switching of Bias

In the image-forming apparatus according to the first embodiment, the bias is applied at −500 V to the fixing film 25 during the conveyance period, and the bias is applied at +800 V to the fixing film 25 in the time interval between sheets. At this time, the timing of switching from the positive bias in the time interval between sheets to the negative bias during the conveyance period is important.

When an end of the recording material P enters the fixing nip, the bias preferably has been applied at −500 V to the fixing film in order to suppress the tailing, as described above. Accordingly, in consideration of a time required for the start of switching of fixing bias, it is necessary for the bias to be switched to the negative bias.

The time required for the start of switching of the fixing bias is affected by the time constant of a high voltage circuit, the degree of the charging-up of the fixing film and the pressure roller, and the moisture content (temperature and humidity) of the environment. A time during which the positive bias is applied in the time interval between sheets is preferably as long as possible in order to suppress the electrostatic offset.

The reason is that as a large amount of the positive electrical charge as possible is to be applied to cancel the negative electrical charge of the surface of the pressure roller 26, as described above. In consideration of conditions under which the tailing and the electrostatic offset are suppressed, the switching is conventionally controlled such that the bias is switched to the negative bias at a predetermined time before the recording material P enters the nip portion (t represents a switching time below). According to conventional techniques, the switching time t is determined to be constant regardless of a time interval d between sheets.

However, because of recent high-speed printing, there has been a need to shorten the time interval d between sheets (time during which the nip portion N is located within the interval between sheets, and no recording material is conveyed at the nip portion N). There has been a problem in that, in the case where the time interval d between sheets is not sufficiently larger than the above t, the electrostatic offset and the tailing at an end portion of the recording material P cannot be solved at the same time. Specifically, in the case of a short time interval between sheets, the electrostatic offset may occur in a successive conveyance period, and in the case of a long time interval between sheets, the end tailing may occur.

In view of this, in the first embodiment, the bias-applying unit 50 applies the bias having the same polarity as the toner to the fixing film 25 when the recording material P passes through the nip portion N and applies the bias having a polarity opposite to the polarity of the toner to the fixing film 25 in the time interval between sheets, in which no recording material P passes through the nip portion N. That is, the bias having a polarity opposite to the polarity of the toner is applied to the fixing film 25 in the time interval between sheets after the preceding recording material P passes through the nip portion N until the succeeding recording material P enters the nip portion N.

The switching time t represents a time between start of switching from the bias having a polarity opposite to the polarity of the toner to the bias having the same polarity as the toner and the recording material P entering the nip portion N in the time interval between sheets. In this case, different switching times for values of the time interval between sheets are recorded in advance. The switching time for the actual time interval between recording materials P is changed on the basis of the recorded relationship between the time interval and the switching time, and the timing of the switching by the bias-applying unit 50 is controlled.

The different switching times for the values of the time interval between sheets are times subsequently mentioned.

Let V0 denote the surface potential of the fixing film when the recording material P passes through the nip portion and the bias having the same polarity as the toner is applied. Let v denote the surface potential of the fixing film 25 that has the maximum absolute value of the polarity opposite to the polarity of the toner in the time interval between recording materials P (no recording material passes through the nip portion). In this case, the different switching times are times required for the surface potential of the fixing film 25 to reach V0 from v depending on the magnitude of |v-V0|, during which the end tailing does not occur.

Fixing bias control according to a first comparative example and a second comparative example will now be described with reference to FIG. 4, FIG. 5, and FIG. 6. In the first and second comparative examples, the switching time t is constant regardless of the time interval between sheets. Under the fixing bias control according to the first comparative example, the switching time t is long (t1=90 msec). Under the fixing bias control according to the second comparative example, the switching time t is short (t2=50 msec).

Figure 4:
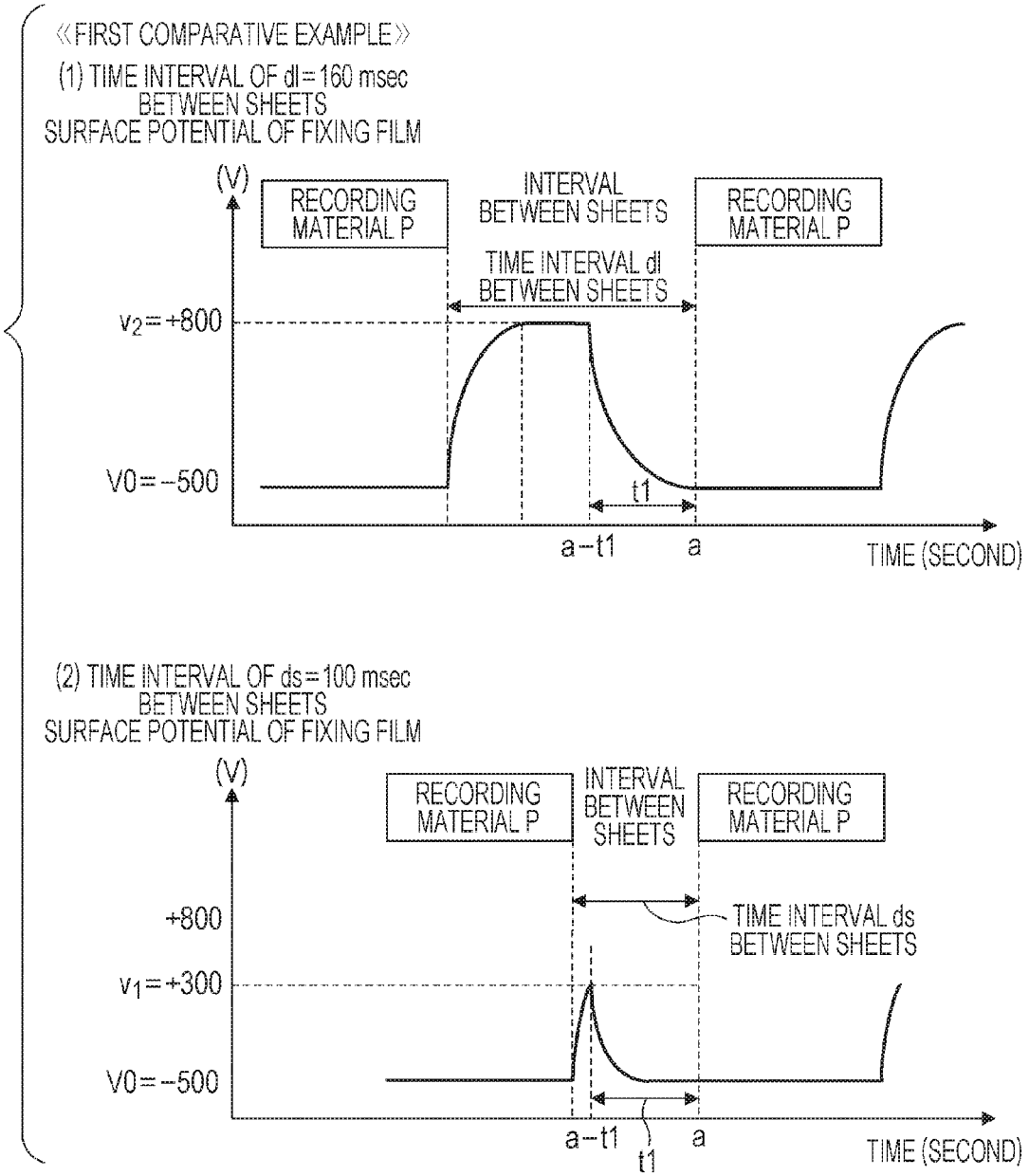
FIG. 4 illustrates graphs of changes in surface potential of a fixing film according to a first comparative example with respect to time.

FIG. 4 illustrates graphs of changes in surface potential of the fixing film with respect to time in the case where the time interval d between sheets is long (d1=160 msec) and in the case where the time interval d between sheets is short (ds=100 msec) under the fixing bias control according to the first comparative example.

Figure 5:
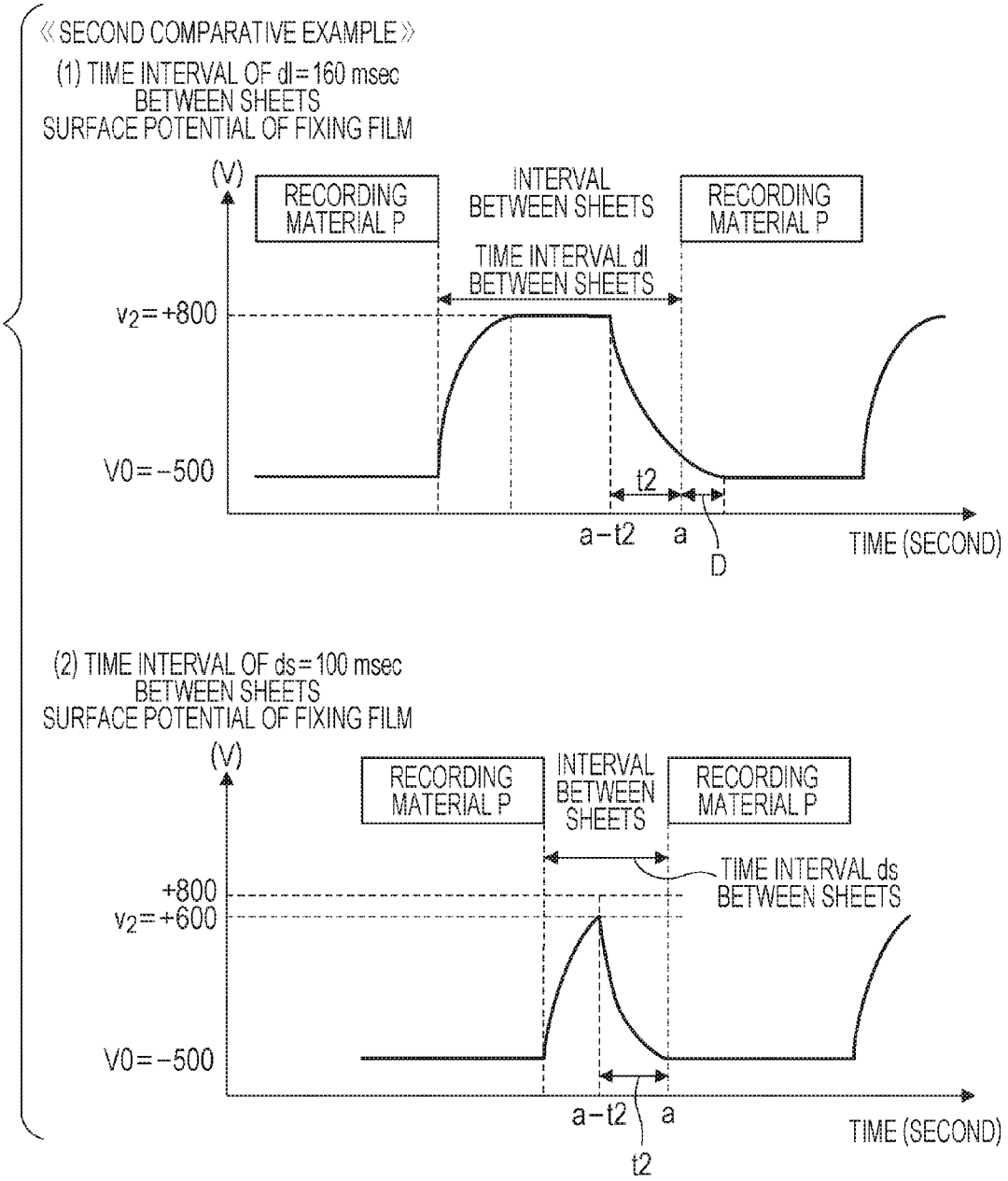
FIG. 5 illustrates graphs of changes in surface potential of a fixing film according to a second comparative example with respect to time.

FIG. 5 illustrates graphs of changes in surface potential of the fixing film with respect to time in the case where the time interval d between sheets is long (d1=160 msec) and in the case where the time interval d between sheets is short (ds=100 msec) under the fixing bias control according to the second comparative example.

Figure 6:
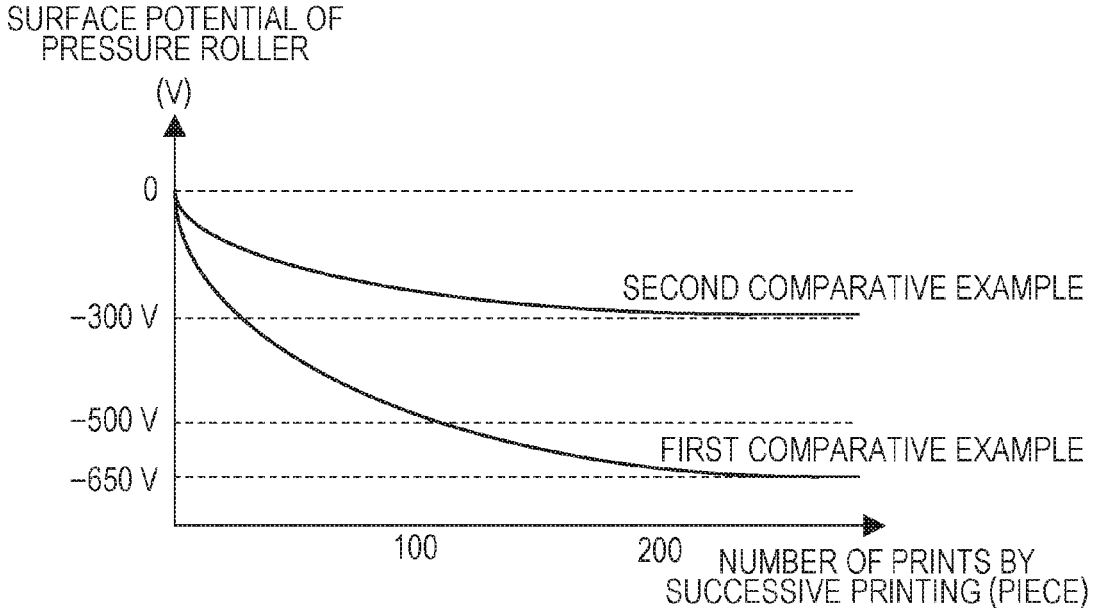
FIG. 6 illustrates a graph of changes in surface potential of a pressure roller according to the first and second comparative examples with respect to the number of prints.

FIG. 6 is a graph illustrating relationships between the surface potential of the pressure roller and the number of prints in the case where the time interval between sheets is determined to be a short interval of ds=100 msec in an image-forming apparatus according to the first comparative example and the second comparative example, and successive printing is performed on 300 sheets.

First Comparative Example

The first comparative example will now be described. In the first comparative example, for a time interval of d1=160 msec between sheets, the switching time is determined to be t=90 msec. The profile of the surface potential of the fixing film is illustrated at (1) in FIG. 4. Specifically, in the first comparative example, the fixing bias is switched from the positive bias to the negative bias with a timing of "a-t1". Consequently, the end tailing does not occur because the surface of the fixing film has been charged at −500 V with a timing of "a" with which an end of the recording material P enters the nip portion N.

In the first comparative example, for a time interval of ds=100 msec between sheets, the switching time is also determined to be t=90 msec. The profile of the surface potential of the fixing film is illustrated at (2) in FIG. 4. Specifically, in the first comparative example, the fixing bias is switched from the positive bias to the negative bias with the timing of "a-t1". Accordingly, a time for applying the positive bias in the time interval between sheets is short, and a sufficient positive electrical charge cannot be applied. Consequently, the surface of the pressure roller cannot be prevented from being charged up due to the negative electrical charge applied from the recording material P.

FIG. 6 illustrates the relationship between the number of prints and the surface potential of the pressure roller in the case where the time interval between sheets is determined to be ds=100 msec in the image-forming apparatus according to the first comparative example, and successive printing is performed.

The pressure roller is not charged up when a sheet starts to be fed. The surface potential of the pressure roller, however, reaches −500 V until about 100 sheets are successively fed and reaches −650V after 250 sheets are fed. Consequently, the negative surface potential of the pressure roller is smaller than the surface potential (−500V) of the fixing film. This creates an electric field that causes the unfixed toner on the recording material P to be attracted to the fixing film, thereby resulting in the occurrence of the offset.

Second Comparative Example

The second comparative example will now be described. In the second comparative example, for a time interval of ds=100 msec between sheets, the switching time is determined to be t=50 msec. The profile of the surface potential of the fixing film is illustrated at (2) in FIG. 5.

Specifically, in the second comparative example, the fixing bias is switched from the positive bias to the negative bias with a timing of "a-t2". Consequently, the positive bias does not reach +800 V, which is a control potential, in the time interval between sheets but only reaches +600 V. Even when the switching time t is a short time of t2=50 msec, the negative bias reaches −500 V at an end of the succeeding recording material P, and accordingly, the tailing does not occur at the end portion.

FIG. 6 illustrates the relationship between the surface potential of the pressure roller and the number of prints in the case of successive printing in the second comparative example. In the second comparative example, for a short time interval of ds=100 msec between sheets, a sufficient positive electrical charge is applied to the surface of the pressure roller in the time interval between sheets, and accordingly, the surface potential of the pressure roller only reaches −300 V even when successive printing is performed on 250 sheets. Consequently, the offset does not occur.

In the second comparative example, for a time interval of d1=160 msec between sheets, the switching time is determined to be t=50 msec. The profile of the surface potential of the fixing film is illustrated at (1) in FIG. 5. In this case, the positive bias reaches +800 V in the time interval between sheets, and accordingly, the negative bias does not reach −500 V at the end portion (region D in the figure) of the succeeding recording material P when the switching time t is a short time of t2. This causes the problem in that the tailing occurs at the end portion of the succeeding recording material Fixing Bias Control In the first embodiment, the relationship between the time interval d between sheets and the proper switching time t is obtained in advance and recorded in a control table. The switching time is derived from the actual time interval d between sheets on the basis of the relationship between the time interval d between sheets and the switching time t that is recorded in the control table. The timing of the switching by the bias-applying unit 50 is thus determined. The timing is determined such that as the time interval d between sheets increases, the switching time t increases.

Table 1 is the control tale that enables the switching time t of the fixing bias to be determined in the first embodiment. In the first embodiment, the time interval d between sheets is assumed from a time interval of actions of feeding sheets by the feed roller 11. In the first embodiment, this is performed for all page printing processes.

TABLE 1

Fixing bias control in first embodiment

| Time interval d between sheets (msec) | Switching time t (msec) |
|---|---|
| d < 60 | t = 30 |
| 60 ≤ d < 120 | t = 50 |
| 120 ≤ d < 180 | t = 90 |
| 180 ≤ d | t = 150 |

Figure 7:
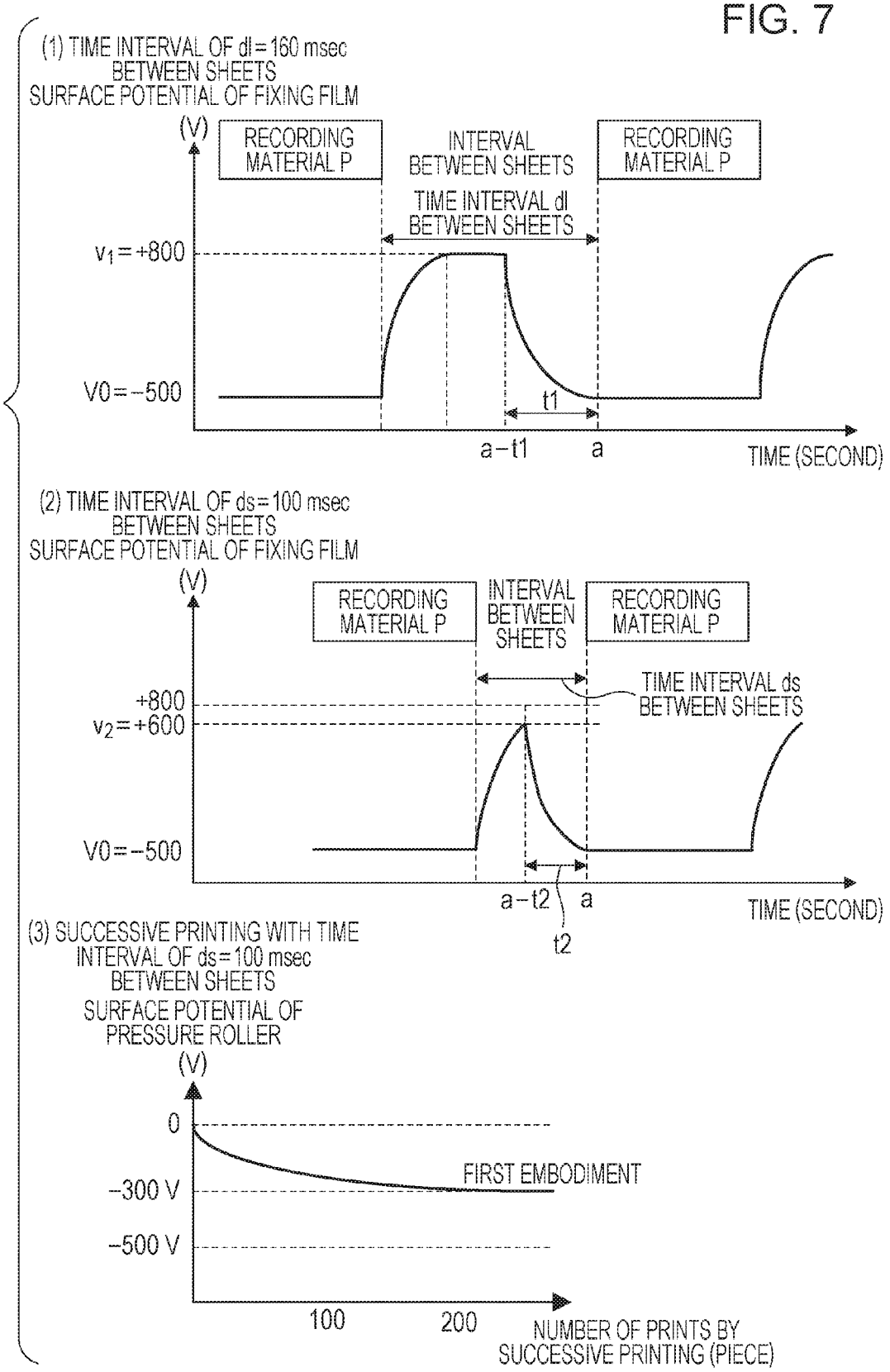
FIG. 7 illustrates graphs of changes in surface potential of the fixing film according to the first embodiment with respect to time, and a change in surface potential of a pressure roller according to the first embodiment with respect to the number of prints.

FIG. 7 illustrates, at (1) and (2), the relationship between the surface potential of the fixing film and the switching time in the image-forming apparatus according to the first embodiment in the case where the time interval d between sheets is determined to be d1=160 msec and ds=100 msec, respectively.

FIG. 7 illustrates, at (3), a graph of the relationship between the surface potential of the pressure roller and the number of prints in the same image-forming apparatus as in the first and second comparative examples in the case where the time interval between sheets is determined to be a short interval of ds=100 msec, and successive printing is performed on 300 sheets.

In the first embodiment, the printing process is performed by using two time intervals of d1=160 msec and ds=100 msec between sheets. The former corresponds to a mode in which a fixing ability is emphasized so as to be achieved even in the case of using sheets having a large basic weight or a rough surface. The latter corresponds to a mode in which the print speed is emphasized.

In the first embodiment, the largest positive bias value v of the surface potential of the fixing film in the time interval between sheets can be predicted from the time interval d between sheets. In the case where the time interval d between sheets is long, the positive value of v is increased. In the case where the time interval d is short, the positive value of v is decreased. For example, in the case where the time interval d between sheets is d=d1=160 msec, the bias reaches $v=v_1=+800$ V, and in the case where the time interval d between sheets is d=ds=100 msec, the bias only reaches $v=v_2=+600$ V.

The bias control of the fixing film according to the first embodiment will now be described.

In the first embodiment, in the case where the time interval between sheets is a long interval of d1=160 msec, the switching time is determined to be t=t1=90 msec according to Table 1. The relationship between the surface potential of the fixing film and time at this time is illustrated at (1) in FIG. 7.

In this case, as illustrated at (1) in FIG. 7, the largest positive bias value of the surface potential of the fixing film 25 reaches $v_1=+800$ V in the time interval between sheets. At this time, it is necessary for the switching time of the bias to be $t_1 \geq 90$ msec for the succeeding recording material P. In the first embodiment, the switching time is determined to be 90 msec. For this reason, the surface potential of the fixing film reaches a desired electric potential (−500 V) at the end portion of the succeeding recording material P. Accordingly, the end tailing does not occur.

In the case where the time interval between sheets is a short interval of ds=100 msec, the switching time t is determined to be t2=50 msec according to the control table illustrated in Table 1. The relationship between the surface potential of the fixing film 25 and time at this time is illustrated at (2) in FIG. 7. The relationship between the surface potential of the pressure roller 26 and the number of prints when successive printing is performed on 250 sheets is illustrated at (3) in FIG. 7.

As illustrated in the graph at (2) in FIG. 7, the largest positive bias value of the surface potential of the fixing film 25 only reaches $v_2=+600$ V in the time interval between sheets. Accordingly, even when the switching time of the bias is determined to be a short time of $t_2=50$ msec for the succeeding recording material P, the surface potential of the fixing film 25 reaches a desired electric potential (V0=−500 V) at the end of the succeeding recording material P. Accordingly, the end tailing does not occur.

In the first embodiment, as illustrated at (2) in FIG. 7, a sufficient positive electrical charge is applied to the surface of the pressure roller 26 in the time interval between sheets, even when the time interval between sheets is a short interval of ds=100 msec. Consequently, as illustrated at (3) in FIG. 7, the surface potential of the pressure roller 26 only reaches −300 V, and the offset does not occur, even when successive printing is performed on 250 sheets. Thus, the use of the control table for the switching time t of the fixing bias according to the first embodiment enables the switching time t to be determined optimally for various time intervals d between sheets, thereby enabling suppression of the electrostatic offset and the end tailing.

Experimental Result in First Embodiment and Comparative Examples

Experiments demonstrating comparison with the image-forming apparatus according to the comparative examples were conducted to describe the effects of the image-forming apparatus according to the first embodiment.

In the image-forming apparatus according to the first embodiment, the switching time t of the fixing bias is determined on the basis of a table illustrated in Table 1. In contrast, in the image-forming apparatus according to the first and second comparative examples, the switching time t was determined to be a fixed value regardless of the time interval d between sheets. The switching time t in the first comparative example was 50 msec, and the switching time t in the second comparative example was 90 msec. Other configurations were the same as in the first embodiment and a description thereof is accordingly omitted.

Conditions of the experiments will now be described.

The conveying speed at which the image-forming apparatuses used in the experiments conveyed the recording materials was 350 mm/sec. An interval in which the feed roller 11 operated was adjusted, and sheets were fed at a time interval d of 100 msec or 160 msec between the sheets.

In the fixing device, the fixing film 25 was pressed against the pressure roller 26 at 186.2 N (19 kgf), and the width of the nip portion was 9 mm. Conditions under which the experiments were conducted were as follows: the temperature was 23° C., the humidity was 50%, and CS-680 (A4 size and 68 g/cm$^2$) made of CANON KABUSHIKI KAISHA was used as evaluation sheets. In each of the image-forming apparatuses under these conditions, 500 sheets were fed in a simplex printing and successive feeding mode, and the level of the electrostatic offset and end tailing was evaluated.

Table 2 illustrates the level of the end tailing and electrostatic offset in the first embodiment and the first and second comparative examples. The symbol o in Table 2 represents that the end tailing and the electrostatic offset did not occur, and the result was good. The symbol X in Table 2 represents that an undesirably high level of the end tailing and full-page offset occurred, and a practical problem existed.

TABLE 2

Result of comparison between first embodiment and first and second comparative examples

| | End tailing | | Electrostatic offset | |
|---|---|---|---|---|
| | Time interval d between sheets | | | |
| Table 2 | 100 msec | 160 msec | 100 msec | 160 msec |
| First embodiment | o | o | o | o |
| First comparative example | o | x | o | o |
| Second comparative example | o | o | x | o |

As illustrated in the result in Table 2, in the image-forming apparatus according to the first embodiment, the end tailing and the electrostatic offset did not occur, and good images were obtained in both cases where the time interval between sheets was 100 msec and where the time interval between sheets was 160 msec. The reason is that the optimal switching time t can be determined even when the time interval d between sheets is changed.

In contrast, in the image-forming apparatus according to the first and second comparative examples, problems occurred. In the first comparative example, the end tailing occurred when the time interval d between sheets was 160 msec. In the second comparative example, the electrostatic offset occurred when the time interval between sheets was 100 msec.

It can be thus understood that the use of the image-forming apparatus according to the first embodiment enables effects that cannot be achieved according to the first and second comparative examples to be achieved, that is, a good image having no end tailing nor electrostatic offset to be obtained. In the first embodiment, the pressure roller 26 is grounded with the core shaft interposed therebetween. However, the same effects can be achieved by applying bias. In this case, the bias having a polarity opposite to the polarity of the toner is preferably applied to the pressure roller 26 while a sheet is being fed and in the time interval between sheets.

In the first embodiment, the electric potential of the fixing film in the time interval between sheets is assumed from the time interval between sheets. However, the surface potential of the fixing film may be directly measured. This enables more precise control.

In an example described in the first embodiment, the bias control unit 54 that switches the bias is, for example, a relay. However, the bias control unit 54 may be a switching unit using, for example, a zener diode. In this case, there is a tendency that a time constant when a voltage is changed is higher than in the case of a method using the relay. Accordingly, the effects of the first embodiment are enhanced.

In the first embodiment, the time interval d between sheets is assumed from the interval in which the feed roller 11 operates. However, the time interval d between sheets may be directly measured by using, for example, a sensor. In this case, an effective method for determining the time interval d between sheets is to use the result of detection by the top sensor 9.

Second Embodiment

A second embodiment will now be described.

The difference between the second embodiment and the first embodiment is only an item about control of the timing with which the fixing bias is applied. The other configurations are the same as in the first embodiment, and a description of the same configurations is omitted.

The structure of an image-forming apparatus according to the second embodiment is suitable to feed the recording material by using multistage cassettes incorporated in the apparatus. In this case, a conveying path from a sheet feeding port to the fixing nip changes depending on the sheet feeding port, and the timing with which the fixing bias is applied can be readily controlled by actual measurement rather than prediction of the time interval between sheets by using the timing with which each sheet is fed.

Accordingly, the difference in the control of the timing with which the fixing bias is applied according to the second embodiment from the first embodiment is that the time interval d between sheets is assumed from the result of detection by the top sensor 9, which serves as a detector that detects an end of the recording material P. The control table is changed so as to correspond the result of actual detection.

Table 3 illustrates the control table according to the second embodiment.

In the second embodiment, a time between detection of the rear end of the preceding sheet and detection of the front end of the succeeding sheet by the top sensor 9 is defined as the time interval d between sheets. The switching time t of the fixing bias in the second embodiment is determined from the obtained time interval d between sheets according to Table 3. In the second embodiment, this is performed for all page printing processes.

TABLE 3

Fixing bias application timing table in second embodiment

| Time interval d between sheets (msec) | Switching time t (msec) |
|---|---|
| $d < 60$ | $t = 30$ |
| $60 \leq d \leq 200$ | $t = d/2$ |
| $200 \leq d$ | $t = 100$ |

Thus, the use of the image-forming apparatus according to the second embodiment enables the switching time t to be determined optimally for the time interval d between sheets, suppressing the occurrence of the end tailing and the electrostatic offset and, enabling a high quality image to be obtained.

Third Embodiment

A third embodiment will now be described.

The difference between the third embodiment and the first embodiment is that a humidity sensor Th that detects the environmental humidity is disposed as a detector that detects the amount of moisture of the environment, and the control table for control of the timing with which the fixing bias is applied is changed. The other configurations are the same as in the first embodiment, and a description of the same configuration is omitted.

In the third embodiment, the humidity sensor Th that detects the environmental humidity is disposed, and the switching time is changed on the basis of the result of the detection by the humidity sensor Th. Specifically, the control table of the fixing bias is changed.

The reason why the control table is thus changed is that the responsiveness of the surface potential of the fixing film 25 is affected by the amount of moisture of the environment. The less the moisture content, that is, the lower the humidity of the environment, the lower the responsiveness. The higher the humidity of the environment, the higher the responsiveness.

Table 4 illustrates the control table of the fixing bias according to the third embodiment.

In the third embodiment, a plurality of the control tables in which the relationship between the time interval d between sheets and the switching time t is recorded are prepared. Specifically, the control tables are divided into three types of "Environmental humidity A: less than 25%", "Environmental humidity B: no less than 25% and no more than 60%", and "Environmental humidity C: 60% or more". The control tables that are used for control are changed on the basis of the result of the detection by the humidity sensor Th.

TABLE 4

| Fixing bias application timing table in third embodiment | |
|---|---|
| Time interval d between sheets (msec) | Switching time t (msec) |
| << Environmental humidity A: less than 25% >> | |
| d < 60 | t = 40 |
| 60 ≤ d ≤ 200 | t = d/2 + 10 |
| 200 ≤ d | t = 110 |
| << Environmental humidity B: no less than 25% and no more than 60% >> | |
| d < 60 | t = 30 |
| 60 ≤ d ≤ 200 | t = d/2 |
| 200 ≤ d | t = 100 |
| << Environmental humidity C: 60% or more >> | |
| d < 60 | t = 20 |
| 60 ≤ d ≤ 200 | t = d/2 − 10 |
| 200 ≤ d | t = 90 |

Thus, the use of the image-forming apparatus according to the third embodiment enables the switching time t to be determined optimally for the environmental humidity, suppressing the occurrence of the end tailing and the electrostatic offset, and enabling a high quality image to be obtained.

In the third embodiment, the environmental humidity is used to detect the moisture content of the environment. However, the moisture content may be directly measured. In a typical environment such as an office, there is a correlation between the temperature and moisture content of the environment. Accordingly, the moisture content of the environment may be assumed from the result of detection by a temperature sensor serving as a detector that detects the temperature of the environment and reflected on the control.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-224574, filed Nov. 17, 2015 which is hereby incorporated by reference herein in its entirety.

What is claimed is:

1. An image-forming apparatus for forming a toner image on a recording material, comprising:

an image-forming unit that forms an unfixed toner image on the recording material;

a fixing device that fixes the unfixed toner image on the recording material, the fixing device including a heating rotator and a pressure member that forms, together with the heating rotator, a nip portion at which the recording material is heated and conveyed;

a bias-applying unit that applies bias to the heating rotator; and a control unit that controls the bias-applying unit, wherein a plurality of image forming modes can be performed in a case where image formation is successively performed on a preceding recording material and a succeeding recording material, each of the plurality of image forming modes having a time interval between the preceding recording material and the succeeding recording material which is different from each other, wherein the control unit executes a first control of the bias-applying unit such that bias having the same polarity as a toner of the unfixed toner image is applied while the recording materials are being conveyed at the nip portion, and a second control of the bias-applying unit such that bias having a polarity opposite to a polarity of the toner is applied while the recording materials are not being conveyed at the nip portion due to the time interval, and wherein a switching time between start of switching from the second control to the first control and completion of the switching in the image forming mode in which the time interval is a first time interval is determined to be longer than in the image forming mode in which the time interval is a second time interval shorter than the first time interval.

2. The image-forming apparatus according to claim 1, wherein the switching time is determined such that, as an absolute value of the bias having the opposite polarity applied to the heating rotator in the second control increases, the switching time increases.

3. The image-forming apparatus according to claim 1, wherein the control unit executes a control of the bias-applying unit such that, as the interval decreases, a maximum value of the bias having the opposite polarity applied to the heating rotator in the second control decreases.

4. The image-forming apparatus according to claim 1, further comprising:

a humidity-detecting member that detects humidity of an environment in which the image-forming apparatus is disposed, wherein the switching time, in a case where a detected humidity detected by the humidity detecting member is a first humidity, is determined to be shorter than in a case where the detected humidity is a second humidity smaller than the first humidity.

5. The image-forming apparatus according to claim 1, wherein the switching from the second control to the first control for the succeeding recording material is completed in the time interval.

6. An image-forming apparatus for forming a toner image on a recording material, comprising:

an image-forming unit that forms an unfixed toner image on the recording material;

a fixing device that fixes the unfixed toner image on the recording material, the fixing device including a heating rotator and a pressure member that forms, together with the heating rotator, a nip portion at which the recording material is heated and conveyed;

a bias-applying unit that applies bias to the heating rotator; and a control unit that controls the bias-applying unit, wherein a plurality of image forming modes in which image formation is successively performed on a preceding recording material and a succeeding recording material can be performed, the plurality of image forming modes including a first image forming mode in which a time interval between the preceding recording material and the succeeding recording material is a first time interval, and a second image forming mode in which the time interval is a second time interval shorter than the first time interval, wherein the control unit executes a first control of the bias-applying unit, in which bias having the same polarity as a toner of the unfixed toner image, is applied, and a second control of the bias-applying unit, in which bias having a polarity opposite to a polarity of the toner, is applied, the control unit executing the first control while the recording material is being conveyed at the nip portion and the second control while the recording material is not being conveyed at the nip portion due to the time interval, and wherein a time period, from a start of switching from the second control to the first control to a timing when a leading end of the succeeding recording material enters the nip portion, in the first interval of the first image forming mode is determined to be longer than the time period in the second time interval of the second image forming mode.

7. The image-forming apparatus according to claim 6, wherein in the second image forming mode, the switching from the second control to the first control is completed in the second time interval.

8. The image-forming apparatus according to claim 7, wherein in the first image forming mode, the switching from the second control to the first control is completed in the first time interval.

* * * * *